US011015397B2

(12) United States Patent
Belnap et al.

(10) Patent No.: US 11,015,397 B2
(45) Date of Patent: May 25, 2021

(54) CUTTING ELEMENTS AND DRILL BITS INCORPORATING THE SAME

(71) Applicant: Smith International, Inc., Houston, TX (US)

(72) Inventors: Lynn Belnap, Spanish Fork, UT (US); Stewart N. Middlemiss, Salt Lake City, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 197 days.

(21) Appl. No.: 15/538,124

(22) PCT Filed: Dec. 4, 2015

(86) PCT No.: PCT/US2015/063919
§ 371 (c)(1),
(2) Date: Jun. 20, 2017

(87) PCT Pub. No.: WO2016/109116
PCT Pub. Date: Jul. 7, 2016

(65) Prior Publication Data

US 2017/0362899 A1 Dec. 21, 2017

Related U.S. Application Data

(60) Provisional application No. 62/098,539, filed on Dec. 31, 2014.

(51) Int. Cl.
*E21B 10/55* (2006.01)
*E21B 10/62* (2006.01)
(Continued)

(52) U.S. Cl.
CPC ..... *E21B 10/5673* (2013.01); *E21B 10/36* (2013.01); *E21B 10/55* (2013.01); *E21B 10/567* (2013.01)

(58) Field of Classification Search
CPC ..... E21B 10/42; E21B 10/43; E21B 10/55; E21B 10/62; E21B 10/627; E21B 10/633; E21B 10/5673
See application file for complete search history.

(56) References Cited

U.S. PATENT DOCUMENTS 1,887,372 A 12/1899 Emmons
3,949,062 A 4/1976 Vereschagin et al.
(Continued)

FOREIGN PATENT DOCUMENTS

WO 2012069465 A1 5/2012
WO 2012171915 A1 12/2012

OTHER PUBLICATIONS

International Preliminary Report on Patentability issued in International Patent application PCT/US2015/063919 dated Jul. 13, 2017, 10 pages.
(Continued)

*Primary Examiner* — Catherine Loikith

(57) ABSTRACT

An ultra-hard cutting element for use in a drill bit, such as a percussion drill bit, a rotary cone drill bit, a drag bit, or a reamer. The ultra-hard cutting element includes a base portion, an extension portion on an end of the base portion, and a lip on an outer surface of the extension portion. At least a portion of the outer surface of the extension portion includes an ultra-hard abrasive material. The ultra-hard abrasive material may be polycrystalline diamond or polycrystalline cubic boron nitride.

20 Claims, 5 Drawing Sheets

(51) Int. Cl.
*E21B 10/567* (2006.01)
*E21B 10/36* (2006.01)

(56) References Cited

U.S. PATENT DOCUMENTS

| | | | | |
|---|---|---|---|---|
| 4,527,643 | A | 7/1985 | Horton et al. | |
| 4,679,971 | A | 7/1987 | Maier | |
| 5,499,688 | A | 3/1996 | Dennis | |
| 5,580,196 | A | 12/1996 | Thompson | |
| 5,779,403 | A | 7/1998 | Kleine et al. | |
| 5,839,526 | A * | 11/1998 | Cisneros | E21B 10/16 175/431 |
| 5,868,885 | A | 2/1999 | Crockett et al. | |
| 6,059,054 | A * | 5/2000 | Portwood | E21B 10/16 175/430 |
| 6,152,657 | A | 11/2000 | Packer et al. | |
| 6,558,519 | B1 | 5/2003 | Dodgson et al. | |
| 6,883,624 | B2 | 4/2005 | McDonough | |
| 6,929,079 | B2 | 8/2005 | McDonough et al. | |
| 7,228,922 | B1 | 6/2007 | DeVall | |
| 7,353,893 | B1 | 4/2008 | Hall et al. | |
| 7,384,105 | B2 | 6/2008 | Hall et al. | |
| 7,469,756 | B2 | 12/2008 | Hall et al. | |
| 7,585,342 | B2 | 9/2009 | Cho | |
| 7,669,126 | B2 | 2/2010 | Morita et al. | |
| 7,686,106 | B2 | 3/2010 | Baker et al. | |
| 7,757,785 | B2 * | 7/2010 | Zhang | E21B 10/55 175/57 |
| 7,757,789 | B2 | 7/2010 | Yong et al. | |
| 7,950,476 | B2 | 5/2011 | McDonough et al. | |
| 8,028,774 | B2 | 10/2011 | Hall et al. | |
| 8,052,765 | B2 | 11/2011 | Cho et al. | |
| 8,061,457 | B2 | 11/2011 | Hall et al. | |
| 8,122,980 | B2 | 2/2012 | Hall et al. | |
| 8,205,692 | B2 * | 6/2012 | McDonough | E21B 10/16 175/327 |
| 8,590,644 | B2 | 11/2013 | Hall et al. | |
| 2006/0144621 | A1 | 7/2006 | Tank et al. | |
| 2008/0006448 | A1 | 1/2008 | Zhang et al. | |
| 2008/0087473 | A1 | 4/2008 | Hall et al. | |
| 2009/0188725 | A1 | 7/2009 | Rai et al. | |
| 2010/0059286 | A1 | 3/2010 | McDonough et al. | |
| 2014/0069725 | A1 | 3/2014 | Yu et al. | |
| 2014/0182947 | A1 | 7/2014 | Bhatia et al. | |

OTHER PUBLICATIONS

International Search Report and Written Opinion issued in International patent application PCT/US2015/063919 dated Apr. 20, 2016. 13 pages.

* cited by examiner

CUTTING ELEMENTS AND DRILL BITS INCORPORATING THE SAME

CROSS REFERENCE

This application claims the benefit of U.S. Provisional Application No. 62/098,539, entitled "CUTTING ELEMENTS AND DRILL BITS INCORPORATING THE SAME," filed Dec. 31, 2014, the disclosure of which is hereby incorporated herein by reference.

BACKGROUND

Systems for drilling wellbores into the earth for the recovery of hydrocarbons, such as oil and natural gas, typically include a drill bit mounted on the lower end of a drill string. Several different types of drill bits exist depending on the primary mechanism by which the drill bit advances into the earthen formation. Common drill bits include rotary cone bits, drag bits, and percussion bits. Additionally, conventional drill bits include a plurality of inserts or cutting elements on a face of the drill bit that are configured to engage the earthen formation.

In a percussion drilling operation, a hammer is repeatedly raised and lowered to strike an end of the percussion bit, which strikes the earthen formation and thereby progressively increases the depth of the wellbore into the earthen formation (e.g., by crushing, breaking, and/or loosening the earthen formation). In a rotary cone drilling operation, a rotary cone bit having one or more cones is rotated against an earthen formation. An axial force is also applied to the rotary cone bit to progressively increase the depth of the wellbore into the earthen formation (e.g., by crushing, breaking, and/or loosening the earthen formation).

With conventional drilling systems, the rate of penetration ("ROP") of the drill bit into the earthen formation is limited, in part, by the energy delivered to the drill bit (e.g., the hammer force applied to the percussion drill bit or the torque applied to the drag bit or the rotary cone drill bit). The ROP of conventional drilling systems is also limited by the geometry and the size of the cutting elements or the portion thereof that engages the earthen formation. For instance, conventional drill bits may include geometric features such that energy delivered to the drill bit during a drilling operation is distributed over a relatively large surface area of the drill bit. Thus, the energy delivered to the drill bit may be dispersed over a relatively large area of the earthen formation, which may limit the ROP of the conventional drilling systems.

SUMMARY

Embodiments of ultra-hard cutting elements for use with a drill bit are disclosed. In one embodiment, the ultra-hard cutting element includes a base portion defining a longitudinal axis, an extension portion on an end of the base portion, and a lip on an outer surface of the extension portion. At least a portion of the outer surface of the extension portion includes an ultra-hard abrasive material. The ultra-hard abrasive material may be polycrystalline diamond or polycrystalline cubic boron nitride. At least a portion of the ultra-hard abrasive material may have a hardness of at least approximately 4000 kg/mm$^2$. The outer surface may include a first spherical portion having a first radius of curvature and a second spherical portion having a second radius of curvature less than the first radius of curvature. The lip may be defined between the first spherical portion and the second spherical portion. The lip may extend beyond the first spherical portion or an outer end of the lip may be flush with the first spherical portion. The lip may include cutting face extending between the first spherical portion and the second spherical portion. The cutting face may be substantially perpendicular to the second spherical portion. The cutting face may be canted at an angle from approximately 15 degrees to approximately 60 degrees relative to the second spherical portion. The lip may extend diametrically across the outer surface. The lip may be offset from the longitudinal axis. A height of the lip may between a higher end proximate the longitudinal axis and lower ends proximate an interface edge between the outer surface and a sidewall of the base portion. A height of the lip may be substantially constant along a length of the lip.

The present disclosure is also directed to various embodiments of a drill bit. In one embodiment, the drill bit includes a shank, a bit body on one end of the shank, a series of cutter pockets in the bit body, and a series of ultra-hard cutting elements at least partially received in the cutter pockets. At least one of the ultra-hard cutting elements includes a base portion defining a longitudinal axis, an extension portion on an end of the base portion, and a lip on an outer surface of the extension portion. At least a portion of the outer surface of the extension portion includes an ultra-hard abrasive material. The ultra-hard abrasive material may be polycrystalline diamond or polycrystalline cubic boron nitride. The outer surface may include a first spherical portion having a first radius of curvature and a second spherical portion having a second radius of curvature less than the first radius of curvature. The lip may be defined between the first spherical portion and the second spherical portion. The lip may extend beyond the first spherical portion or an outer end of the lip may be flush with the first spherical portion. The lip may extend diametrically across the outer surface. A height of the lip may between a higher end proximate the longitudinal axis and lower ends proximate an interface edge between the outer surface and a sidewall of the base portion. A height of the lip may substantially constant along a length of the lip. The ultra-hard cutting elements may be oriented on the bit body such that the lips extend radially toward a longitudinal axis of the shank.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of ultra-hard cutting elements for use in a drill bit, such as, for instance, a percussive drill bit, a rotary cone bit, a drag bit, or a reamer, for drilling a wellbore into an earthen formation for the recovery of hydrocarbons. Embodiments of the ultra-hard cutting elements of the present disclosure include geometric features configured to increase the rate of penetration ("ROP") of the drill bit into the earthen formation compared to conventional drill bits. Embodiments of the ultra-hard cutting elements of the present disclosure may include one or more geometric features configured to concentrate the force of the hammering action of the drill bit onto a localized area of the earthen formation. Embodiments of the cutting elements of the present disclosure may also include one or more geometric features configured to cut into the earthen formation during the rotary action of the drill bit.

Figure 1:
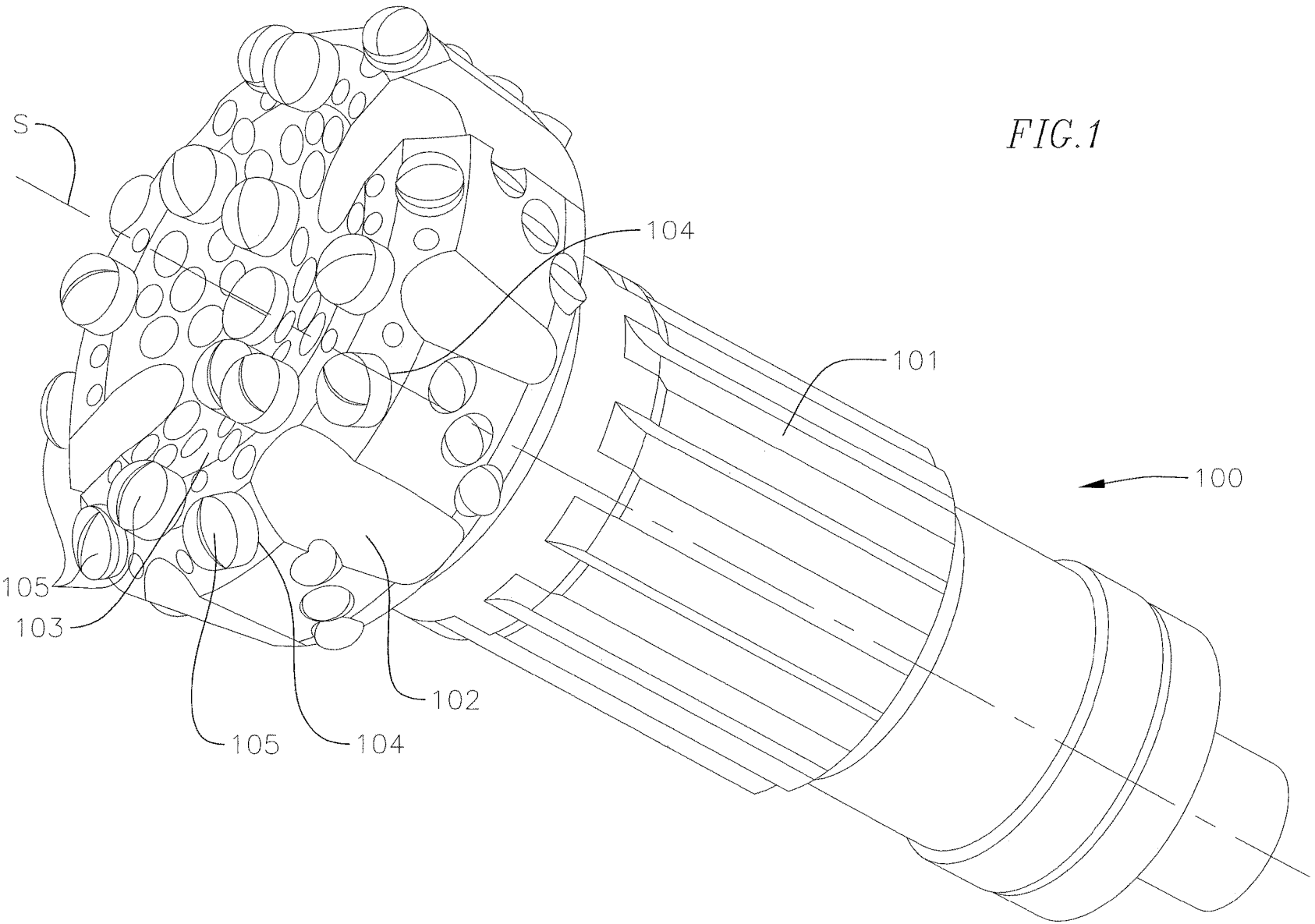
FIG. 1 is a perspective view of a drill bit including a plurality of cutting elements according to one embodiment of the present disclosure.

With reference now to FIG. 1, a drill bit 100 according to one embodiment of the present disclosure is a percussive drill bit 100 configured for use in a percussive drilling operation. The percussive drill bit 100 includes a shank 101 and a bit body 102 coupled to the shank 101. The bit body 102 includes a formation engaging bit face 103. The formation engaging bit face 103 defines a plurality of cutter pockets 104 configured to receive and support a plurality of ultra-hard cutting elements 105. The ultra-hard cutting elements 105 may be coupled to the drill bit 100 by any suitable manufacturing process or technique, such as, for instance, brazing, welding, mechanical fastening, or any combination thereof.

Figure 2A:
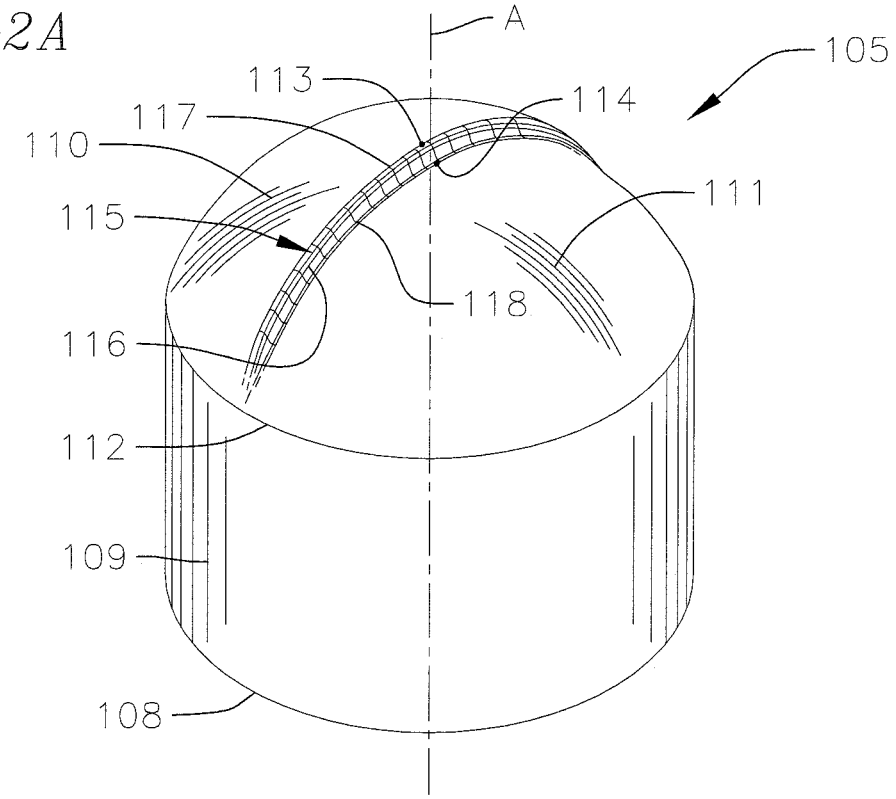
FIGS. 2A and 2B are a perspective view and a side view, respectively, of a cutting element according to one embodiment of the present disclosure.
Figure 2B:
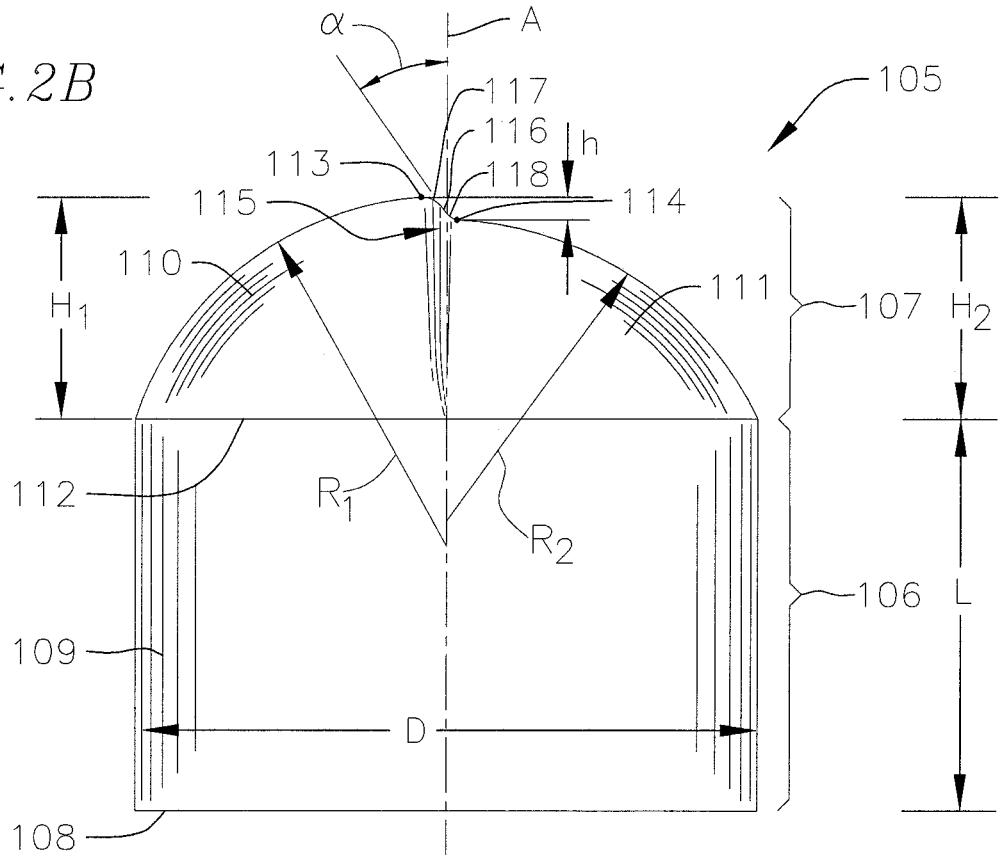

With reference now to FIGS. 2A and 2B, the ultra-hard cutting element 105 in the illustrated embodiment includes a base portion 106 and an extension portion 107 coupled to or integrally formed with the base portion 106. In the illustrated embodiment, the base portion 106 is cylindrical and includes a circular base 108 and a cylindrical sidewall 109 extending from the circular base 108. In one or more embodiments, the base portion 106 of the ultra-hard cutting element 105 may have any other suitable shape depending, for instance, on the composition of the earthen formation the drill bit 100 is intended to drill through and the type of drill bit with which the ultra-hard cutting element 105 is used. The base portion 106 also defines a longitudinal axis A. The cylindrical sidewall 109 of the base portion 106 may have any suitable diameter D and any suitable length L along the longitudinal axis A.

The extension portion 107 of the ultra-hard cutting element 105 includes first and second outer formation-engaging surfaces 110, 111. The ultra-hard cutting element 105 also includes a circumferential edge 112 at the interface between the extension portion 107 and the cylindrical sidewall 109 of the base portion 106. In the illustrated embodiment, the outer formation-engaging surfaces 110, 111 of the extension portion 107 are spherical or substantially spherical. The extension portion 107 also defines a pair of apices or crowns 113, 114 on the first and second outer formation-engaging surfaces 110, 111, respectively, that are furthest from the circular base 108 of the base portion 106. The outer formation-engaging surfaces 110, 111 of the extension portion 107 have a maximum height $H_1$, $H_2$, respectively, defined between the apices 113, 114 and a plane that is perpendicular to the longitudinal axis A and extends through the circumferential edge 112. The outer formation-engaging surfaces 110, 111 of the extension portion 107 also have radii of curvature $R_1$, $R_2$, respectively. In one embodiment, the maximum heights $H_1$, $H_2$ of the outer formation-engaging surfaces 110, 111 of the extension portion 107 may be less than the respective radii of curvature $R_1$, $R_2$ of the outer formation-engaging surfaces 110, 111. In one or more alternate embodiments, the maximum heights $H_1$, $H_2$ of the outer formation-engaging surfaces 110, 111 of the extension portion 107 may be equal or substantially equal to the respective radii of curvature $R_1$, $R_2$ of the outer formation-engaging surfaces 110, 111. In one or more embodiments, the outer formation-engaging surfaces 110, 111 of the extension portion 107 may have any other suitable shape, such as, for instance, ellipsoidal or substantially ellipsoidal. Additionally, in one or more embodiments, at least one of the outer formation-engaging surfaces 110, 111 may include a flat or substantially flat segment or portion (e.g., at least one of the outer formation-engaging surfaces 110, 111 may include a straight segment and a curved segment).

Still referring to the embodiment illustrated in FIGS. 2A and 2B, the maximum height $H_1$ and the radius of curvature $R_1$ of the first outer formation-engaging surface 110 are larger than the maximum height $H_2$ and the radius of curvature $R_2$, respectively, of the second outer formation-engaging surface 111. Accordingly, the first and second outer formation-engaging surfaces 110, 111 of the ultra-hard cutting element 105 define a ridge or a lip 115 (i.e., the lip 115 extends between the first outer formation-engaging surface 110 and the second outer formation-engaging surface 111). In the illustrated embodiment, the lip 115 extends radially outward from the apices 113, 114 of the outer formation-engaging surfaces toward the circumferential interface edge 112 (e.g., the lip 115 extends diametrically across the extension portion 107 of the ultra-hard cutting element 105). Accordingly, in the illustrated embodiment, ends of the lip 115 are perpendicular or substantially perpendicular to the circumferential interface edge 112. Although in the illustrated embodiment, the ultra-hard cutting element 105 includes a single lip 115, in one or more alternate embodiments, the ultra-hard cutting element 105 may include any other suitable number of lips 115, such as, for instance, from two to eight lips. Furthermore, in the illustrated embodiment, the lip 115 extends completely to the circumferential interface edge 112 (e.g., the lip 115 extends diametrically across the extension portion 107). In one or more embodiments, the lip 115 may extend radially across the extension portion 107. Accordingly, in the illustrated embodiment, ends of the lip 115 intersect the circumferential interface edge 112 at opposing points. In one or more alternate embodiments, the lip 115 may not extend completely to the circumferential interface edge 112. Furthermore, although in the illustrated embodiment the lip 115 is straight or substantially straight, in one or more embodiments, the lip 115 may not be straight (e.g., the lip 115 may be curved). Additionally, although in the illustrated embodiment the lip 115 extends diametrically across the extension portion 107 such that the lip 115 passes through the longitudinal axis A, in one or more alternate embodiments, the lip 115 may be offset (i.e., spaced apart) from the longitudinal axis A by any suitable distance. In an embodiment in which the lip 115 is spaced apart from the longitudinal axis A, the ends of the lip 115 may not be orthogonal to the circumferential interface edge 112 (e.g., the ends of the lip 115 may be oriented at an acute angle relative to the circumferential interface edge 112).

In the illustrated embodiment, the lip 115 includes a cutting face 116 configured cut into the earthen formation when the ultra-hard cutting element 105 is rotated against the earthen formation. In the illustrated embodiment, the cutting face 116 of the lip 115 is canted at an angle $\alpha$ relative to a plane perpendicular to the first and second outer formation-engaging surfaces 110, 111. In one embodiment, the angle $\alpha$ of the cutting face 116 relative to the first and second outer formation-engaging surfaces 110, 111 may be from approximately 15 degrees to approximately 60 degrees. In one or more embodiments, the angle $\alpha$ of the cutting face 116 may be less than approximately 15 degrees or greater than approximately 60 degrees. In one or more alternate embodiments, the cutting face 116 of the lip 115 may be perpendicular or substantially perpendicular to the first and second outer formation-engaging surfaces 110, 111. Additionally, in the illustrated embodiment, an outer end 117 of the cutting face 116 is rounded such that the lip 115 blends into the first outer formation-engaging surface 110 (e.g., the outer end 117 of the cutting face 116 may include a radius). In one or more alternate embodiments, the outer end 117 of the cutting face 116 may define a sharp edge. In one or more alternate embodiments, the outer end 117 of the cutting face 116 may include a chamfer. Opposite sides of the chamfer may be either rounded (e.g., include a radius) or may define sharp edges. Additionally, in one embodiment, an inner end 118 of the cutting face 116 may be rounded such that the lip 115 blends into the second outer formation-engaging surface 111, although in one or more alternate embodiments, the inner end 118 of the lip 115 may define a sharp edge.

A height h of the lip 115 is defined between the inner end 118 and the outer end 117 of the cutting face 116 (i.e., the height h of the lip 115 is defined between the first outer formation-engaging surface 110 and the second outer formation-engaging surface 111). In the illustrated embodiment, the height h of the lip 115 tapers between a highest point proximate the apex 113 of the first outer formation-engaging surface 110 (i.e., the intersection between the longitudinal axis A and the first outer formation-engaging surface 110) and lowest points proximate the circumferential interface edge 112 where the extension portion 107 joins the sidewall 109 of the base portion 106. In one or more embodiments, the highest point of the lip 115 may be at any other suitable location, such as, for instance, proximate the circumferential interface edge 112 or at an intermediate point between the apex 113 and the circumferential interface edge 112. Additionally, in the illustrated embodiment, the height h of the lip 115 at or proximate the circumferential interface edge 112 is zero or substantially zero. In one or more embodiments, the radius of curvature $R_1$ of the first outer formation-engaging surface 110 and/or the radius of curvature $R_2$ of the second outer formation-engaging surface 111 varies such that the height h of the lip 115 tapers toward the circumferential interface edge 112. In one or more alternate embodiments, the height h of the lip 115 may be constant or substantially constant along the length of the lip 115. In one embodiment in which the height h of the lip 115 is constant or substantially constant, the radii of curvature $R_1$, $R_2$ of the first and second outer formation-engaging surfaces 110, 111 may not vary (i.e., the radii of curvature $R_1$, $R_2$ of the first and second outer formation-engaging surfaces 110, 111 may be constant or substantially constant). In one or more embodiments, the lip 115 may include a segment or a portion that has a constant or substantially constant height and a segment that tapers between a higher end and a lower end. In one embodiment, the height h of the lip 115 may not taper uniformly. The lip 115 may have any suitable maximum height h depending, for instance, on the desired performance characteristics of the ultra-hard cutting element 105 and the composition of the earthen formation the ultra-hard cutting element 105 is intended to drill through. In one embodiment, the ratio of the maximum height h of the lip 115 to the diameter D of the cylindrical sidewall 109 of the ultra-hard cutting element 105 may be from approximately 0.01 to approximately 0.4. In one or more embodiments, the ratio of the maximum height h of the lip 115 to the diameter D of the cylindrical sidewall 109 of the ultra-hard cutting element 105 may be from approximately 0.01 to approximately 0.1. In one or more embodiments, the ratio of the maximum height h of the lip 115 to the diameter D of the cylindrical sidewall 109 may be greater than 0.4. In another embodiment, the ratio of the maximum height h of the lip 115 to the diameter D of the cylindrical sidewall 109 may be less than 0.01.

At least a portion of the first outer formation-engaging surface 110, the second outer formation-engaging surface 111, and/or the lip 115 may be formed from any material having highly abrasive and/or wear-resistant properties. In one embodiment, at least a portion of the outer formation-engaging surfaces 110, 111 and the lip 115 may include polycrystalline diamond ("PCD") or polycrystalline cubic boron nitride ("PCBN"). In one embodiment, the outer formation-engaging surfaces 110, 111 and the lip 115 of the ultra-hard cutting element 105 may include any suitable type of thermally stable polycrystalline diamond (e.g., leached PCD, non-metal catalyst PCD, or catalyst-free PCD) or thermally stable PCBN. In one embodiment, the material of at least a portion of the outer formation-engaging surfaces 110, 111 and the lip 115 of the ultra-hard cutting element 105 may have a hardness greater than or equal to approximately 4000 kg/mm$^2$. In one or more alternate embodiments, the material of at least a portion of the outer formation-engaging surfaces 110, 111 and the lip 115 of the ultra-hard cutting element 105 may have a hardness less than approximately 4000 kg/mm$^2$. Although in one embodiment only the outer formation-engaging surfaces 110, 111 and the lip 115 (or portions thereof) are formed from PCD or PCBN, in one or more embodiments, any other suitable portion of the extension portion 107 may be formed from PCD or PCBN. For instance, in one embodiment, all or substantially all of the extension portion 107 may be formed from PCD or PCBN. Additionally, in one or more embodiments, the material properties of at least one of the outer formation-engaging surfaces 110, 111 and the lip 115 may be different than the material properties of at least one of the other outer formation-engaging surfaces 110, 111 and the lip 115. For instance, in one embodiment, one of the outer formation-engaging surfaces 110, 111 or the lip 115 may have a hardness less than one of the other outer formation-engaging surfaces 110, 111 or the lip 115 by approximately 500 kg/mm$^2$ to approximately 2500 kg/mm$^2$, such as, for instance, by approximately 2200 kg/mm$^2$.

In one embodiment, a remainder of the ultra-hard cutting element 105 (i.e., the portion of the ultra-hard cutting element 105 other than the outer formation-engaging surfaces 110, 111 and the lip 115) may be formed from any suitably hard and durable material, such as, for instance, tungsten carbide or other matrix materials of carbides, nitrides, and/or borides. In one embodiment, the material of the remainder of the ultra-hard cutting element 105 may be selected to facilitate coupling (e.g., by welding or brazing)

the ultra-hard cutting element 105 to the percussion drill bit 100 during a process of manufacturing the drill bit 100, as described in more detail below. Additionally, in one embodiment, a portion of the material of the remainder of the ultra-hard cutting element 105 may be infiltrated into interstitial spaces (e.g., pores or voids) defined between a network of interconnected crystals of the PCD or PCBN outer formation-engaging surfaces 110, 111 and/or the PCD or PCBN cutting face 116 of the lip 115.

In one embodiment, the ultra-hard cutting element 105 may include one or more transition layers (e.g., a diamond-tungsten carbide composite material). For instance, in one embodiment, the ultra-hard cutting element 105 may include a transition layer between the PCD or PCBN outer formation-engaging surfaces 110, 111 and the lip 115 and an inner portion of the ultra-hard cutting element 105 formed from tungsten carbide. The material of the transition layer may be selected such that the transition layer has a coefficient of thermal expansion that is between a coefficient of thermal expansion of the PCD or PCBN outer formation-engaging surfaces 110, 111 and the lip 115 and a coefficient of thermal expansion of tungsten carbide of the inner portion of the ultra-hard cutting element 105. In one embodiment, the material of the transition layer may also be selected such that the transition layer has an elastic modulus that is between the elastic modulus of the PCD or PCBN outer formation-engaging surfaces 110, 111 and the lip 115 and the elastic modulus of the tungsten carbide of the inner portion of the ultra-hard cutting element 105. In one embodiment, a portion of the transition layer may be infiltrated into the interstitial spaces defined between the network of interconnected crystals of the PCD or PCBN outer formation-engaging surfaces 110, 111 and/or the PCD or PCBN lip 115 (e.g., cobalt from the transition layer may be infiltrated into the PCD or PCBN on the outer formation-engaging surfaces 110, 111 and/or infiltrated into the PCD or PCBN on the lip 115). Accordingly, in one embodiment, the transition layer may be configured to mitigate the formation of thermal stress concentrations which might otherwise develop when the ultra-hard cutting element 105 is subject to elevated temperatures, such as during a drilling operation, due to the thermal expansion differential between the PCD or PCBN layer and the tungsten carbide (i.e., the one or more transition layers may be configured to mitigate the formation of thermal cracks in the outer formation-engage surfaces 110, 111 and/or the lip 115 due to the thermal expansion differential between the PCD or PCBN on the outer formation-engaging surfaces 110, 111 and the lip 115 and the inner tungsten carbide, which may result in the premature failure of the ultra-hard cutting element 105). The transition layer may also serve to reduce the elastic mismatch between the PCD or PCBN outer formation-engaging surfaces 110, 111 and the lip 115 and the tungsten carbide of the inner portion of the ultra-hard cutting element 105, thereby improving reliability of the ultra-hard cutting element 105, particularly during dynamic loading of the ultra-hard cutting element 105.

Figure 3A:
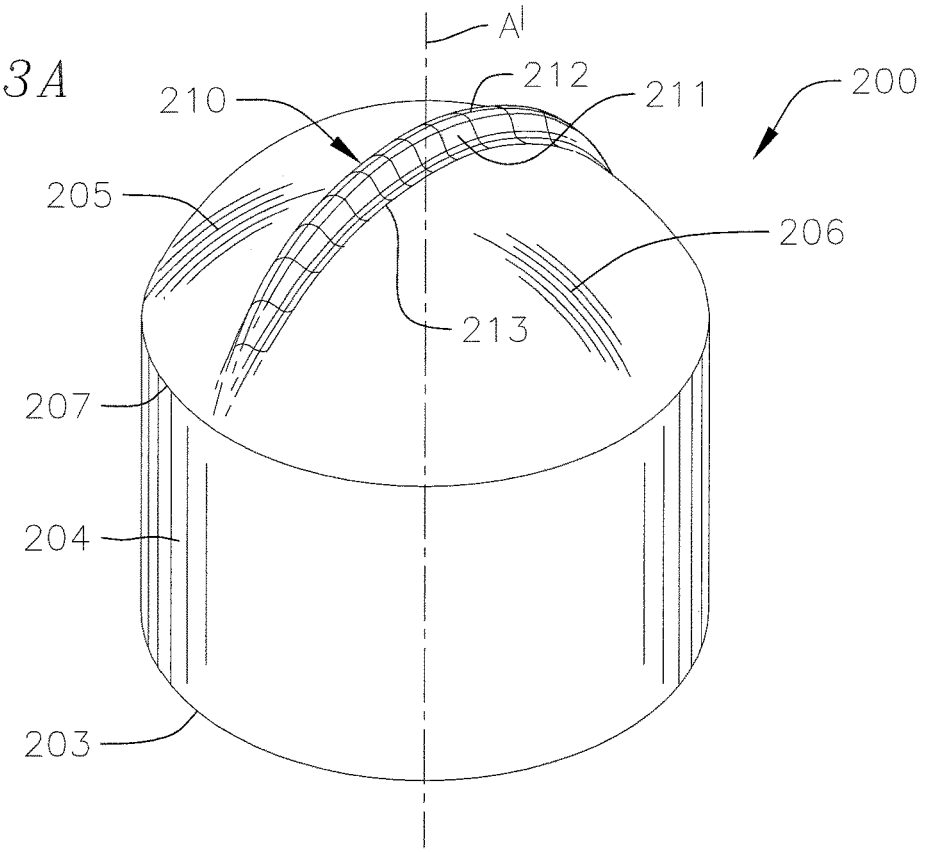
FIGS. 3A and 3B are a perspective view and a side view, respectively, of a cutting element according to another embodiment of the present disclosure.
Figure 3B:
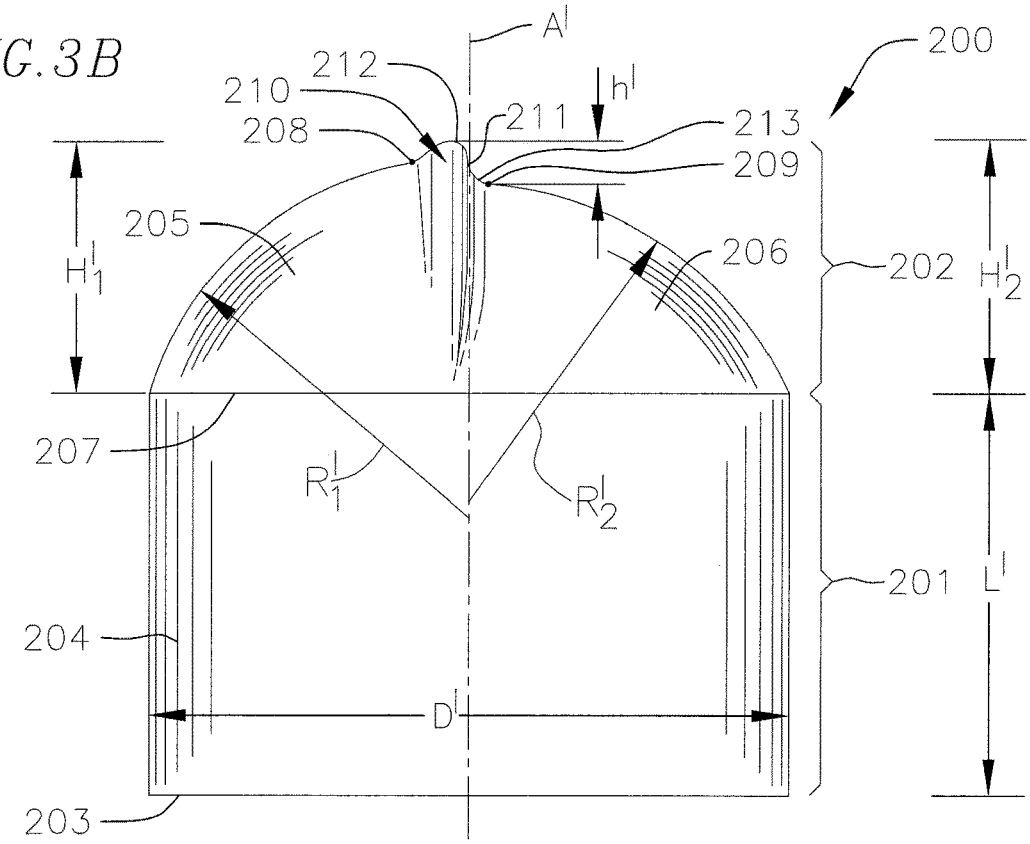

With reference now to FIGS. 3A and 3B, an ultra-hard cutting element 200 according to another embodiment of the present disclosure includes a base portion 201 and an extension portion 202 coupled to or integrally formed with the base portion 201. In the illustrated embodiment, the base portion 201 is cylindrical and includes a circular base 203 and a cylindrical sidewall 204 extending from the circular base 203. In one or more embodiments, the base portion 201 of the ultra-hard cutting element 200 may have any other suitable shape depending, for instance, on the composition of the earthen formation the drill bit 100 (see FIG. 1) is intended to drill through and the type of drill bit with which the ultra-hard cutting element 200 is used. The base portion 201 also defines a longitudinal axis A'. The cylindrical sidewall 204 of the base portion 201 may have any suitable diameter D' and any suitable length L' along the longitudinal axis A'.

The extension portion 202 of the ultra-hard cutting element 200 includes first and second outer formation-engaging surfaces 205, 206. The ultra-hard cutting element 200 also includes a circumferential edge 207 at the interface between the extension portion 202 and the cylindrical sidewall 204 of the base portion 201. In the illustrated embodiment, the outer formation-engaging surfaces 205, 206 of the extension portion 202 are spherical or substantially spherical. The extension portion 202 also defines a pair of apices or crowns 208, 209 on the first and second outer formation-engaging surfaces 205, 206, respectively, that are furthest from the circular base 203 of the base portion 201. The outer formation-engaging surfaces 205, 206 of the extension portion 202 have a maximum height $H_1'$, $H_2'$, respectively, defined between the apices 208, 209 and a plane that is perpendicular to the longitudinal axis A' and extends through the circumferential edge 207. The outer formation-engaging surfaces 205, 206 of the extension portion 202 also have radii of curvature $R_1'$, $R_2'$, respectively. In one embodiment, the maximum heights $H_1'$, $H_2'$ of the outer formation-engaging surfaces 205, 206 of the extension portion 202 may be less than the respective radii of curvature $R_1'$, $R_2'$ of the outer formation-engaging surfaces 205, 206. In one or more alternate embodiments, the maximum heights $H_1'$, $H_2'$ of the outer formation-engaging surfaces 205, 206 of the extension portion 202 may be equal or substantially equal to the respective radii of curvature $R_1'$, $R_2'$ of the outer formation-engaging surfaces 205, 206. In one or more embodiments, the outer formation-engaging surfaces 205, 206 of the extension portion 202 may have any other suitable shape, such as, for instance, ellipsoidal or substantially ellipsoidal. Additionally, in one or more embodiments, at least one of the outer formation-engaging surfaces 205, 206 may include a flat or substantially flat segment or portion (e.g., at least one of the outer formation-engaging surfaces 205, 206 may include a straight segment and a curved segment).

Still referring to the embodiment illustrated in FIGS. 3A and 3B, the maximum height $H_1'$ and the radius of curvature $R_1'$ of the first outer formation-engaging surface 205 are larger than the maximum height $H_2'$ and the radius of curvature $R_2'$, respectively, of the second outer formation-engaging surface 206. Accordingly, the first and second outer formation-engaging surfaces 205, 206 of the ultra-hard cutting element 200 define a ridge or a lip 210 (i.e., the lip 210 extends between the first outer formation-engaging surface 205 and the second outer formation-engaging surface 206). Unlike the lip 115 described above with reference to the embodiment of the ultra-hard cutting element 105 illustrated in FIGS. 2A and 2B, the lip 210 in the embodiment illustrated in FIGS. 3A and 3B projects above the first outer formation-engaging surface 205. Additionally, in the illustrated embodiment, the lip 210 extends radially outward from the apices 208, 209 of the outer formation-engaging surfaces 205, 206 toward the circumferential interface edge 207 (e.g., the lip 210 extends diametrically across the extension portion 202 of the ultra-hard cutting element 200). Accordingly, in the illustrated embodiment, ends of the lip 210 are perpendicular or substantially perpendicular to the circumferential interface edge 207. Although in the illustrated embodiment, the ultra-hard cutting element 200 includes a single lip 210, in one or more alternate embodiments, the ultra-hard cutting element 200 may include any other suitable number of lips 210, such as, for instance, from two to eight lips. Furthermore, in the illustrated embodiment, the lip 210 extends completely to the circumferential interface edge 207 (e.g., the lip 210 extends diametrically across the extension portion 202 of the ultra-hard cutting element 200). Accordingly, in the illustrated embodiment, ends of the lip 210 intersect the circumferential interface edge 207 at opposing points. In one or more alternate embodiments, the lip 210 may not extend completely to the circumferential interface edge 207. Furthermore, although in the illustrated embodiment the lip 210 is straight or substantially straight, in one or more embodiments, the lip 210 may not be straight (e.g., the lip 210 may be curved). Additionally, although in the illustrated embodiment the lip 210 extends diametrically across the extension portion 202 such that the lip 210 passes through the longitudinal axis A', in one or more alternate embodiments, the lip 210 may be offset (i.e., spaced apart) from the longitudinal axis A' by any suitable distance. In an embodiment in which the lip 210 is spaced apart from the longitudinal axis A', the ends of the lip 210 may not be orthogonal to the circumferential interface edge 207 (e.g., the ends of the lip 210 may be oriented at an acute angle relative to the circumferential interface edge 207).

In one embodiment, at least a portion of the first and second outer formation-engaging surfaces 205, 206 and the lip 210 may be formed from any material having highly abrasive and/or wear-resistant properties, such as, for instance, PCD, PCBN, and/or any material having a hardness greater than or equal to approximately 4000 kg/mm$^2$. In one or more embodiments, the first and second outer formation-engaging surfaces 205, 206 and the lip 210 may be formed from a material having a hardness less than approximately 4000 kg/mm$^2$. Although in one embodiment only the first and second outer formation-engaging surfaces 205, 206 and the lip 210 (or portions thereof) of the extension portion 202 are formed from PCD or PCBN, in one or more embodiments, any other suitable portion of the extension portion 202 may be formed from PCD or PCBN. For instance, in one embodiment, all or substantially all of the extension portion 202 may be formed from PCD or PCBN. Additionally, in one or more embodiments, the material properties of at least one of the outer formation-engaging surfaces 205, 206 and the lip 210 may be different than the material properties of at least one of the other outer formation-engaging surfaces 205, 206 and the lip 210. For instance, in one embodiment, one of the outer formation-engaging surfaces 205, 206 or the lip 210 may have a hardness less than one of the other outer formation-engaging surfaces 205, 206 or the lip 210 by approximately 500 kg/mm$^2$ to approximately 2500 kg/mm$^2$, such as, for instance, by approximately 2200 kg/mm$^2$.

In the illustrated embodiment, the lip 210 includes a cutting face 211 configured cut into the earthen formation when the ultra-hard cutting element 200 is rotated against the earthen formation. In the illustrated embodiment, the cutting face 211 of the lip 210 is perpendicular or substantially perpendicular to the first and second outer formation-engaging surfaces 205, 206. In one or more embodiments, the cutting face 211 of the lip 210 may canted at an angle relative to a plane perpendicular to the first and second outer formation-engaging surfaces 205, 206. Additionally, in the illustrated embodiment, an outer end 212 of the cutting face 211 is rounded such that the lip 210 blends into the first outer formation-engaging surface 205. In one or more alternate embodiments, the outer end 212 of the cutting face 211 may define a sharp edge. In one or more alternate embodiments, the outer end 212 of the cutting face 211 may include a chamfer. Opposite sides of the chamfer may be either rounded (e.g., include a radius) or may define sharp edges. Additionally, in one embodiment, an inner end 213 of the cutting face 211 may be rounded such that the lip 210 blends into the second outer formation-engaging surface 206, although in one or more alternate embodiments, the inner end 213 of the lip 210 may define a sharp edge.

Accordingly, when the ultra-hard cutting element 200 is used in a rotary hammer or hammer drilling operation, the hammering force is initially concentrated on the lip 210 because the lip 210 projects above the first outer formation-engaging surface 205 (i.e., the hammering force imparted to the ultra-hard cutting element 200 during a drilling operation is initially concentrated on the lip 210, rather than distributed across the area of the first and second outer formation-engaging surfaces 205, 206). The concentration of the hammering force onto the lip 210 may increase the rate of penetration of the drill bit 100 incorporating the ultra-hard cutting element 200 into an earthen formation compared to conventional drill bits (i.e., when the ultra-hard cutting elements 200 of the present disclosure are used in a rotary percussive drilling operation, the geometry of the cutting elements 200 is configured to concentrate the percussive force of the impact on a localized region of the earthen formation corresponding to the size of the lip 210, which serves to advance the drill bit further into the earthen formation). Additionally, in a rotary hammer drilling operation the percussive drill bit 100 is rotated to index the drill bit 100 to a new earthen formation with each impact. Accordingly, when the ultra-hard cutting element 200 is used in a rotary hammer drilling operation, the cutting face 211 of the lip 210 is configured to shear or cut into the earthen formation due to the rotation of the drill bit 100.

A height h' of the lip 210 is defined between the inner end 213 and the outer end 212 of the cutting face 211. In the illustrated embodiment, the height h' of the lip 210 tapers between a highest point proximate the apices 208, 209 of the outer formation-engaging surfaces 205, 206 (i.e., the intersection between the longitudinal axis A' and the outer formation-engaging surface 205, 206) and lowest points proximate the circumferential interface edge 207 where the extension portion 202 joins the sidewall 204 of the base portion 201. In one or more embodiments, the highest point of the lip 210 may be at any other suitable location, such as, for instance, proximate the circumferential interface edge 207 or at an intermediate point between the apices 208, 209 and the circumferential interface edge 207. Additionally, in the illustrated embodiment, the height h' of the lip 210 at or proximate the circumferential interface edge 207 is zero or substantially zero. In one or more embodiments, the radius of curvature $R_1'$ of the first outer formation-engaging surface 205 and/or the radius of curvature $R_2'$ of the second outer formation-engaging surface 206 varies such that the height h' of the lip 210 tapers toward the circumferential interface edge 207. In one or more alternate embodiments, the height h' of the lip 210 may be constant or substantially constant along the length of the lip 210. In one embodiment in which the height h' of the lip 210 is constant or substantially constant, the radii of curvature $R_1'$, $R_2'$ of the first and second outer formation-engaging surfaces 205, 206 may not vary (i.e., the radii of curvature $R_1'$, $R_2'$ of the first and second outer formation-engaging surfaces 205, 206 may be constant or substantially constant). In one or more embodiments, the lip 210 may include a segment or a portion that has a constant or substantially constant height and a segment that tapers between a higher end and a lower end. In one embodiment, the height h' of the lip 210 may not taper uniformly. The lip 210 may have any suitable maximum height h' depending, for instance, on the desired performance characteristics of the ultra-hard cutting element 200 and the composition of the earthen formation the ultra-hard cutting element 200 is intended to drill through. In one embodiment, the ratio of the maximum height h' of the lip 210 to the diameter D' of the cylindrical sidewall 204 of the ultra-hard cutting element 200 may be from approximately 0.01 to approximately 0.4. In one or more embodiments, the ratio of the maximum height h' of the lip 210 to the diameter D' of the cylindrical sidewall 204 of the ultra-hard cutting element 200 may be from approximately 0.01 to approximately 0.1. In one or more embodiments, the ratio of the maximum height h' of the lip 210 to the diameter D' of the cylindrical sidewall 204 may be greater than 0.4. In another embodiment, the ratio of the maximum height h' of the lip 210 to the diameter D' of the cylindrical sidewall 204 may be less than 0.01.

In one embodiment, the ultra-hard cutting element 200 may include one or more transition layers (e.g., a diamond-tungsten carbide composite material). For instance, in one embodiment, the ultra-hard cutting element 200 may include a transition layer between the PCD or PCBN outer formation-engaging surfaces 205, 206 and the lip 210 and an inner portion of the ultra-hard cutting element 200 formed from tungsten carbide. The material of the transition layer may be selected such that the transition layer has a coefficient of thermal expansion that is between a coefficient of thermal expansion of the PCD or PCBN outer formation-engaging surfaces 205, 206 and the lip 210 and a coefficient of thermal expansion of tungsten carbide of the inner portion of the ultra-hard cutting element 200. In one embodiment, the material of the transition layer may also be selected such that the transition layer has an elastic modulus that is between the elastic modulus of the PCD or PCBN outer formation-engaging surfaces 205, 206 and the lip 210 and the elastic modulus of the tungsten carbide of the inner portion of the ultra-hard cutting element 200. In one embodiment, a portion of the transition layer may be infiltrated into the interstitial spaces defined between the network of interconnected crystals of the PCD or PCBN outer formation-engaging surfaces 205, 206 and/or the PCD or PCBN lip 210 (e.g., cobalt from the transition layer may be infiltrated into the PCD or PCBN on the outer formation-engaging surfaces 205, 206 and/or infiltrated into the PCD or PCBN on the lip 210).

The ultra-hard cutting elements 105, 200 of the present disclosure may have any suitable arrangement and orientation on the drill bit 100 (see FIG. 1) depending, for instance, on the type of drill bit and the type of drilling operation (e.g., a rotary drill operation or a percussion drilling operation) the ultra-hard cutting elements 105, 200 are intended to perform. For instance, in one embodiment, the ultra-hard cutting elements 105, 200 may be oriented on the drill bit 100 such that the lips 115, 210 extend radially inward toward a longitudinal axis S of the shank 101 of the drill bit 100 (e.g., the lips 115, 210 may be oriented along radial lines originating from the longitudinal axis S of the drill bit 100). Additionally, in one embodiment, the ultra-hard cutting elements 105, 200 may be oriented on the drill bit 100 such that the cutting faces 116, 211 of the ultra-hard cutting elements 105, 200 are advanced into the earthen formation during a drilling operation (e.g., depending on the direction of rotation of the drill bit 100, the ultra-hard cutting elements 105, 200 may be oriented on the drill bit 100 such that the cutting faces 116, 211 face toward and are advanced into the earthen formation).

Figure 4:
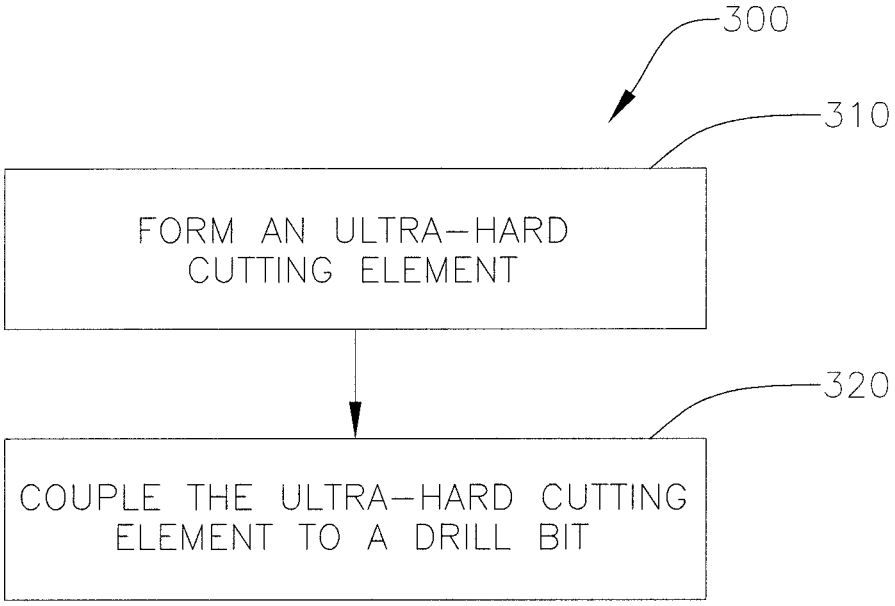
FIG. 4 is flowchart illustrating tasks of a method of manufacturing a drill bit according to one embodiment of the present disclosure.
Figure 5:
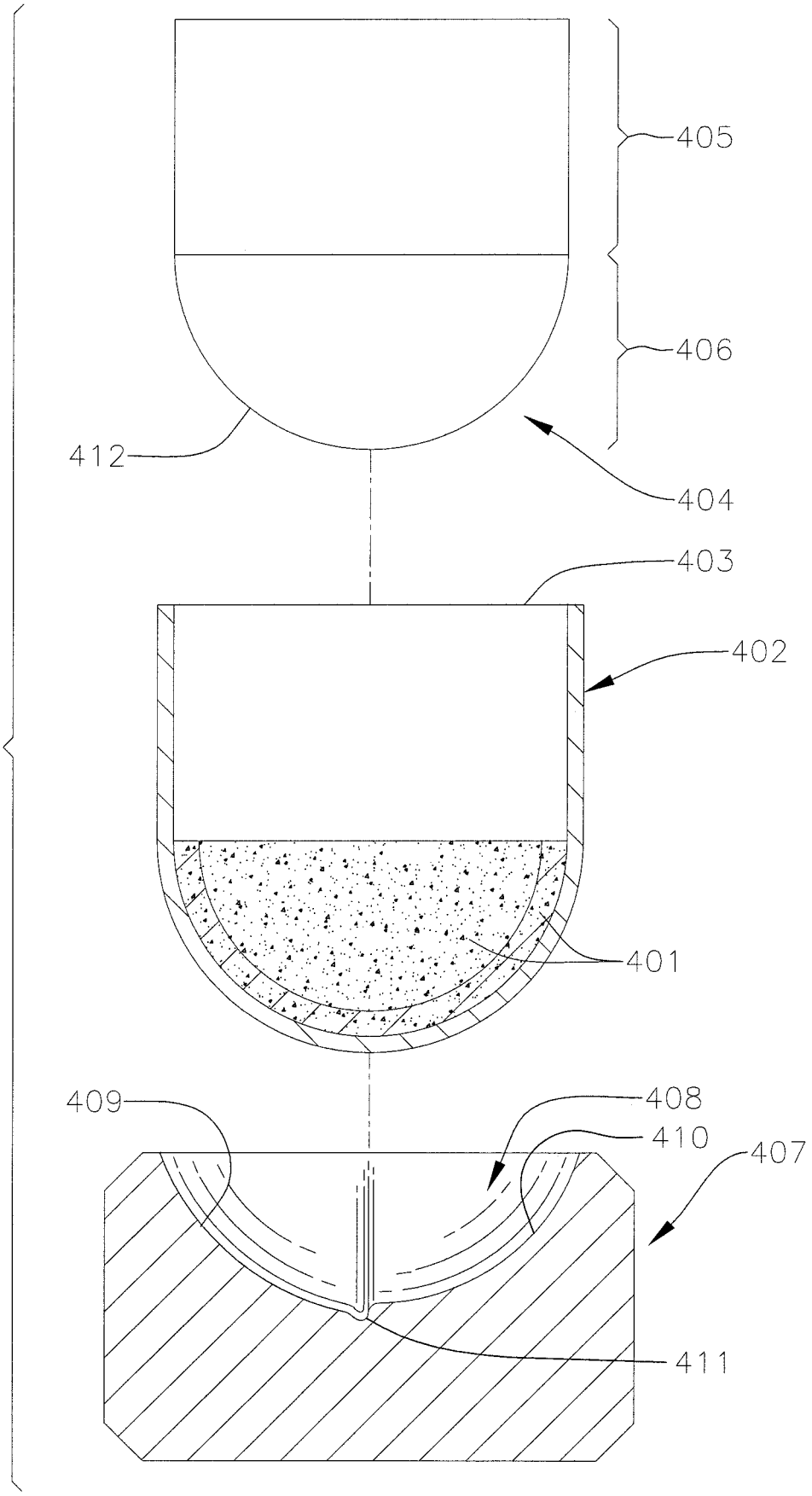
FIG. 5 is a schematic view of a device for manufacturing a drill bit according to one embodiment of the present disclosure.

With reference now to FIGS. 4 and 5, a method 300 of manufacturing a drill bit 100 (see FIG. 1) according to one embodiment of the present disclosure includes a task 310 of forming an ultra-hard cutting element (e.g., an ultra-hard cutting element 105, 200 according to one embodiment described above with reference to FIGS. 2A-3B). In one embodiment, the task 310 of forming the ultra-hard cutting element 105, 200 includes inserting a plurality of solid particulates 401 into a deformable can 402. In the illustrated embodiment, the deformable can 402 is a hollow shell having an open upper end 403. In one or more embodiments, the solid particulates 401 may be or include diamond (e.g., diamond crystals), cobalt, tungsten, cubic boron nitride, or any combination thereof. In one embodiment, the composition of the solid particulates 401 may be selected to include highly abrasive and/or wear-resistant properties depending, for instance, on the desired performance characteristics of the ultra-hard cutting element 105, 200 and/or the composition of the earthen formation the ultra-hard cutting element 105, 200 is intended to drill through. In one or more embodiments, the solid particulates 401, when sintered, may have a hardness greater than or equal to approximately 4000 $kg/mm^2$. Additionally, in one or more embodiments, the task 310 may include inserting a transition layer material into the can 402. The solid particulates 401 of the ultra-hard material and/or the transition layer may also include one or more binder materials. The binder serves to bond the particles together during a subsequent task of forming and shaping the layers of the ultra-hard cutting element 105, 200. The binder material may be any suitable material or materials, such as, for instance, various waxes, polymers, or other organic materials. The binder material may be subsequently removed from the layers following the formation of the ultra-hard cutting element 105, 200 by any suitable manufacturing process or technique, such as, for instance, by chemical reaction, high-temperature decomposition, and/or solvent extraction.

With continued reference to FIGS. 4 and 5, the task 310 of forming the ultra-hard cutting element 105, 200 also includes at least partially inserting a substrate 404 into the can 402 through the open upper end 403. In the illustrated embodiment, the substrate 404 includes a base portion 405 and an extension portion 406 extending from one end of the base portion 405. Additionally, in the illustrated embodiment, the base portion 405 is cylindrical and the extension portion 406 is spherical (e.g., hemispherical or a spherical cap or dome), although in one or more alternate embodiments the substrate 404 may have any other suitable shape depending on the desired shape of the ultra-hard cutting element 105, 200. The substrate 404 may be formed from any suitable strong and durable material, such as, for instance, tungsten carbide. The material of the substrate 404 may also be selected to facilitate coupling the ultra-hard cutting element 105, 200 to a drill bit 100 (see FIG. 1) (e.g., by welding or brazing) during a subsequent task, described below.

With continued reference to FIGS. 4 and 5, the task 310 of forming the ultra-hard cutting element 105, 200 also includes pressing the can 402, and the substrate 404 at least partially received therein, down onto a forming device 407. In the illustrated embodiment, the forming device 407 includes a recess 408 configured to receive at least a portion of the can 402 and the substrate 404 received therein. In the illustrated embodiment, the recess 408 in the forming device 407 includes first and second inner surfaces 409, 410. Additionally, in the illustrated embodiment the first and second inner surfaces 409, 410 are spherical, although in one or more embodiments, the first and second inner surfaces 409, 410 may have any other suitable shape. The recess 408 in the forming device 407 may also include one or more protrusions and/or one or more depressions. In the illustrated embodiment, the recess 408 in the forming device includes a depression 411 between first and second inner surfaces 409, 410.

In one embodiment, the forming device 407 is configured to deform the can 402, the solid particulates 401, and the extension portion 406 of the substrate 404 into the shape of the first and second inner surfaces 409, 410 and the depression 411 when the can 402 and the substrate 404 are pressed onto the recess 408 in the forming device 407. In one embodiment, the forming device 407 may be configured not to deform the extension portion 406 of the substrate 404 (e.g., the forming device 407 may be configured to deform only the solid particulates 401 and the deformable can 402). In one or more alternate embodiments, the can 402 may not be deformable and the can 402 may be pre-formed or pre-shaped into the desired shape (or a portion thereof) of the ultra-hard cutting element 105, 200. In the illustrated embodiment, the first and second inner surfaces 409, 410 in the forming device 407 are configured to form first and second outer formation-engaging surfaces of the ultra-hard cutting element 105, 200 (e.g., the first and second outer formation-engaging surfaces 110, 111 in FIGS. 2A and 2B or the first and second outer formation-engaging surfaces 205, 206 in FIGS. 3A and 3B). Additionally, in the illustrated embodiment, the depression 411 is configured to form a lip in the ultra-hard cutting element 105, 200 (e.g., the lip 210 in FIGS. 2A and 2B). The shape, size, and orientation of the depression 411 in the forming device 407 correspond to the desired configuration of the lip on the ultra-hard cutting element 105, 200. In one or more alternate embodiments, the forming device 407 may be provided without a depression (e.g., to form the embodiment of the ultra-hard cutting element 105 illustrated in FIGS. 2A and 2B). Accordingly, in one or more embodiments, the recess 408 in the forming device 407 may be a negative impression of the desired shape of the extension portion 107, 202 of the ultra-hard cutting element 105, 200.

Pressing the can 402 and the substrate 404 onto the forming device 407 may also cause the solid particulates 401 (e.g., diamond powder) to become a solid mass. Pressing the can 402 and the substrate 404 onto the forming device 407 may also create a connection (e.g., a press-fit connection) between the solid particulate mass 401 and an outer surface 412 of the extension portion 406 of the substrate 404.

Still referring to FIGS. 4 and 5, the task 310 of forming the ultra-hard cutting element 105, 200 also includes exposing the substrate 404 and the solid particulate mass 401 to a high pressure, high temperature ("HPHT") sintering process. The HPHT sintering process may be performing during or after the process of pressing the can 402 and the substrate 404 onto the forming device 407. In an embodiment in which the solid particulates 401 include diamond powder, the HPHT sintering process causes the solid particulate mass 401 to form into a polycrystalline diamond structure having a network of intercrystalline bonded diamond crystals.

A catalyst material may be used to facilitate and promote the inter-crystalline bonding of the diamond crystals. In one or more embodiments, the catalyst material may be mixed into the diamond powder prior to the HPTP sintering process and/or may infiltrate the diamond powder from an adjacent substrate during the HPHT sintering process. The HPHT sintering process creates a polycrystalline diamond structure having a network of intercrystalline bonded diamond crystals, with the catalyst material remaining in interstitial spaces (e.g., voids or gaps) between the bonded diamond crystals. In one embodiment, the catalyst material may be a solvent catalyst metal selected from Group VIII of the Periodic table (e.g., iron), Group IX of the Periodic table (e.g., cobalt), or Group X of the Periodic table (e.g., nickel). Accordingly, the HPHT sintering process forms the ultra-hard cutting element 105, 200 having a substrate 404 and solid particulate mass 401 (e.g., polycrystalline diamond structure) coupled to the outer surface 412 of the substrate 404. The ultra-hard cutting element 105, 200 may be removed from the can 402 and the forming device 407 following the HPHT sintering process.

The method 300 may also include a task 320 of coupling a plurality of the ultra-hard cutting elements 105, 200 to a drill bit (e.g., a percussion drill bit 100, a rotary cone drill bit, a drag bit, or a reamer). In one embodiment, the task 320 of coupling the ultra-hard cutting elements 105, 200 to the drill bit includes brazing the ultra-hard cutting elements 105, 200 in the cutter pockets 104 defined in the bit face 103 of the drill bit 100. In one or more embodiments, the task 320 of coupling the ultra-hard cutting elements 105, 200 to the drill bit may include any other suitable manufacturing technique or process, such as, for instance, welding (e.g., laser beam welding).

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween.

What is claimed is:

1. An ultra-hard cutting element for use in a drill bit, comprising:

a base portion defining a longitudinal axis;

an extension portion on an end of the base portion, wherein at least a portion of an outer surface of the extension portion includes an ultra-hard abrasive material selected from the group consisting of polycrystalline diamond or polycrystalline cubic boron nitride; and a lip on the outer surface of the extension portion, the lip having a length between a first end and a second end, wherein the extension portion outer surface includes a first outer surface portion being spherical or elliptical and extending from the base portion to the lip, and a second outer surface portion being spherical or elliptical and extending from the base portion to the lip, wherein the lip is between the first and second outer surface portions, and wherein the first outer surface portion extends to a maximum first height as measured axially from the base portion, and wherein the second outer surface portion extends to a maximum second height as measured axially from the base portion, wherein the maximum first height is greater than the maximum second height.

2. The ultra-hard cutting element of claim 1, wherein at least a portion of the ultra-hard abrasive material has a hardness of at least approximately 4000 kg/mm$^2$.

3. The ultra-hard cutting element of claim 1, wherein the first outer surface portion is spherical having a first radius of curvature and the second outer surface portion is spherical having a second radius of curvature less than the first radius of curvature.

4. The ultra-hard cutting element of claim 3, wherein the lip extends beyond the first spherical portion.

5. The ultra-hard cutting element of claim 3, wherein an outer end of the lip is flush with the first spherical portion.

6. The ultra-hard cutting element of claim 3, wherein the lip comprises a cutting face extending between the first spherical portion and the second spherical portion.

7. The ultra-hard cutting element of claim 6, wherein the cutting face is substantially perpendicular to the second spherical portion.

8. The ultra-hard cutting element of claim 6, wherein the cutting face is canted at an angle from approximately 15 degrees to approximately 60 degrees relative to the second spherical portion.

9. The ultra-hard cutting element of claim 1, wherein the lip extends diametrically across the outer surface.

10. The ultra-hard cutting element of claim 1, wherein the lip is offset from the longitudinal axis.

11. The ultra-hard cutting element of claim 1, wherein a height of the lip tapers between a higher end proximate the longitudinal axis and lower ends proximate an interface edge between the outer surface and a sidewall of the base portion.

12. The ultra-hard cutting element of claim 1, wherein a height of the lip is substantially constant along the length of the lip.

13. The ultra-hard cutting element of claim 1, wherein the base portion is cylindrical.

14. The ultra-hard cutting element of claim 1, wherein an outer surface of the lip comprises the ultra-hard abrasive material extending from the first outer surface portion to the second outer surface portion.

15. The ultra-hard cutting element of claim 1, wherein the element has a lip height defined as the height of the lip relative to the second height, and a ratio of the lip height to the diameter of the base portion is from 0.01 to 0.4.

16. A drill bit, comprising:

a shank;

a bit body on one end of the shank, the bit body defining a plurality of cutter pockets; and a plurality of ultra-hard cutting elements at least partially received in the plurality of cutter pockets, wherein at least one of the plurality of ultra-hard cutting elements comprises:

a base portion defining a longitudinal axis;

an extension portion on an end of the base portion, wherein at least a portion of an outer surface of the extension portion includes an ultra-hard abrasive material selected from the group consisting of polycrystalline diamond or polycrystalline cubic boron nitride; and a lip on the outer surface of the extension portion, the lip having a length between a first end and a second end, wherein the extension portion outer surface includes a first outer surface portion being spherical or elliptical and extending from the base portion to the lip, and a second outer surface portion being spherical or elliptical surface and extending from the base portion to the lip, wherein the lip is between the first and second outer surface portions, and wherein the first outer surface portion extends to a maximum first height as measured axially from the base portion, and wherein the second outer surface portion extends to a maximum second height as measured axially from the base portion, wherein the maximum first height is greater than the maximum second height.

17. The drill bit of claim 16, wherein the first outer surface portion is spherical having a first radius of curvature and the second outer surface portion is spherical having a second radius of curvature less than the first radius of curvature.

18. The drill bit of claim 16, wherein the lip extends diametrically across the outer surface.

19. The drill bit of claim 16, wherein the ultra-hard cutting elements are oriented on the bit body such that the lip extend radially toward a longitudinal axis of the shank.

20. The drill bit of claim 16, wherein an outer surface of the lip comprises the ultra-hard abrasive material extending from the first outer surface portion to the second outer surface portion.

* * * * *